United States Patent [19]

Fast

[11] Patent Number: 4,888,897

[45] Date of Patent: Dec. 26, 1989

[54] PRODUCT IDENTIFICATION TAG WITH SPECIALIZED MOUNTING PORTION

[76] Inventor: Jacob Fast, 7561 NW. 9th St., Plantation, Fla. 33317

[21] Appl. No.: 254,572

[22] Filed: Oct. 7, 1988

[51] Int. Cl.[4] ..... A47G 29/10

[52] U.S. Cl. ..... 40/657

[58] Field of Search ..... 40/657, 662, 124.1, 40/308, 324; 248/220.4, 300; 211/54.1, 57.1, 59.1

[56] References Cited

U.S. PATENT DOCUMENTS 4,525,944 7/1985 Fast ..... 40/124.1
4,703,570 11/1987 Fast ..... 40/19.5
4,715,135 12/1987 Fast ..... 40/642

*Primary Examiner*—Robert P. Swiatek

*Assistant Examiner*—Cary E. Stone

*Attorney, Agent, or Firm*—Fleit, Jacobson, Cohn, Price, Holman & Stern

[57] ABSTRACT

A product information and display tag has a mounting portion particularly designed for use in attaching the tag to a flip lock-type elongate product display hook. The mounting portion of the tag has panels which can be folded into a wedge-like configuration to be trapped between a pivotal hook bracket and an apertured board when mounting prongs on the bracket are inserted through adjacent board apertures. The respective panels forming the wedge are provided with aligned apertures for receipt of the hook prongs and a cut-out is provided at the top of a front panel for accommodating the top shoulder of the hook when attaching the structure to the apertured board.

8 Claims, 2 Drawing Sheets

PRODUCT IDENTIFICATION TAG WITH SPECIALIZED MOUNTING PORTION

BACKGROUND OF THE INVENTION

This invention relates to product identification and information tags for merchandise suspended from elongate horizontally oriented support hooks and the like. More particularly, the invention relates to such tags which may be readily attached to and removed from the support hooks without being subject to inadvertent removal and which display product information forwardly of the merchandise supported on a hook.

The invention is particularly concerned with a product identification and information tag that may conveniently be used with a form of elongate support hook known as a Trion Flip Lock hook which is a form of hook particularly adapted for mounting on a perforated board. The elongate hook body itself is made of a metal rod which has a plastic bracket secured at its proximal end. The plastic bracket has a pair of rearwardly projecting hook-like prongs which are spaced to fit in a pair of adjacent apertures of a perforated board. To mount the hook on a board, the plastic bracket is elevated so that the tips of the respective prongs are adjacent the front of the board aligned with the mounting perforations. Then, the bracket is swung downwardly about its pivotal connection with the elongate hook, causing the prongs to enter the board perforations and grip around the back of the board thereby securely and releasably attaching the hook to the board. To release the hook from the board, conversely, the bracket is swung or flipped to its upper position.

It is an object of the present invention to provide a product identification and information tag which has a proximal end mounting portion particularly suitable for use in connection with an elongate product support hook of the type described above.

SUMMARY OF THE INVENTION

The invention provides an elongate product identification and information tag of the type referred to comprising generally, a proximal end mounting portion, an elongate intermediate portion for extending over an elongate product support hook, and a distal end portion for displaying product information and the like at a distal end of the tag. In accordance with the invention, the mounting portion of the tag is formed of plural panels divided by transverse bend lines which enable the mounting portion to be folded into a generally triangular or wedge-shaped configuration similar in structure to tags, for examples, shown in my earlier U.S. Pat. Nos. 4,525,944 and 4,703,570. The mounting portion of the subject tag, differs however from the tags disclosed in the earlier patents insofar as it is particularly adapted for attachment to a product display hook of the type previously referred to which incorporates a pivotal plastic bracket. Thus, the mounting portion is provided with spaced apertures to receive the bracket prongs and there is also a cut-out formation centrally disposed in the mounting portion at the top of the wedge to accommodate the proximal end of the upper metal hook body when the plastic bracket of the hook is swung or flipped between its respective upper and lower positions.

Features and advantages of the invention will be discussed in more detail below in connection with the description of the preferred embodiment.

DESCRIPTION OF THE PREFERRED EMBODIMENT

Figure 1:
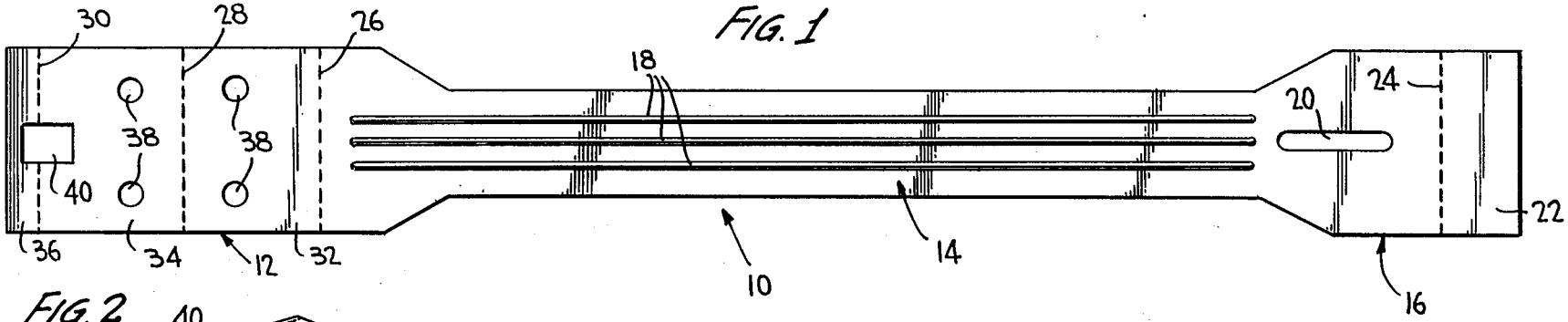
FIG. 1 is a plan view of a plastic blank for a product information and display tag in accordance with the invention.

Referring initially to FIG. 1, there is shown an elongate die-cut plastic blank 10 generally comprising a proximal end mounting portion 12, an elongate central portion 14, and a distal end display portion 16. It will be noted that the central portion 14 is somewhat thinner than the end portions and is provided with longitudinal reinforcing ribs 18. The purpose of reducing the width of the central portion is to reduce the surfaces of the tag available for dust collection and this central portion construction is disclosed in detail in my U.S. Pat. No. 4,715,135 issued Dec. 29, 1987, the contents of which is expressly incorporated herein by reference.

The blank 10 is intended for folding into an elongate product information and display tag for use with a product suspension hook as will be described. Thus, the distal end portion 16 is provided with a slot 20 for receiving the bent distal end of the hook, in known manner, and portion 16 also has a fold down front panel 22 for receipt of a product label or the like. Panel 22 folds about a transverse bend line 24. Alternatively, the distal portion 16 of the blank may be provided with attachment means for a separate label holding or like panel.

Figure 2:
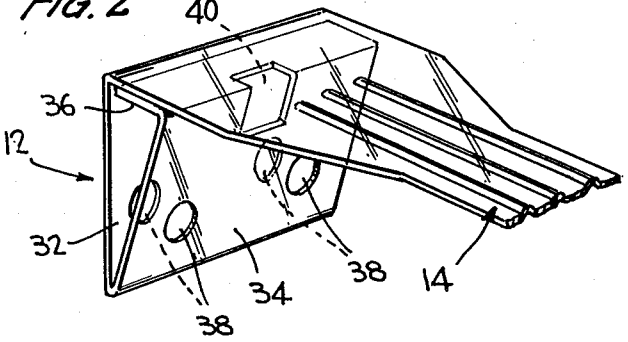
FIG. 2 is a perspective view of a proximal end portion of the blank folded to provide a mounting portion of the tag.

The proximal end mounting portion 12 of the blank is divided by three transverse bend lines 26, 28 and 30 into respective first, second and third panels 32, 34 and 36. The panels 32 and 34 are of similar length while panel 36 is very much shorter so that the mounting portion 12 can be folded along the bend lines 26, 28 and 30 into a narrow triangular configuration or wedge as shown in FIG. 2. Further, panels 32 and 34 are each provided with a pair of aligning apertures 38 spaced to accommodate the mounting prongs of a product display hook as will be described. Also, a rectangular cut-out 40 is provided to extend across bend line 30 with a portion of the cut-out in the respective panels 34 and 36. The cut-out defines means for providing clearance for the proximal end of the hook body when mounting the tag, as will be described below.

The tag 10 is primarily intended for use with a product display hook of the previously referred to Flip Lock type which is shown in detail in FIGS. 3 to 6. A hook of this nature comprises an elongate hook body 42 in the form of a metal rod with a proximal end stem portion 44 bent at an angle approaching 90° to the body 42. Also, a metal cross pin 46 is welded to stem 44 to provide a pivotal support for a plastic mounting bracket 48. Bracket 48 has an open channel 50 which snaps onto the cross pin 46 to form the pivotal mounting. Projecting from a rear surface 52 of the bracket are a pair of hook shaped mounting prongs 54 spaced apart at a like spacing to the apertures 38, for mounting the hook structure in a pair of adjacent perforations 56 of a perforated board 58. The plastic bracket 48 additionally has an operating tab 60 and an elongate recess 63 on the back surface to accommodate stem 44 of the hook when the structure is mounted on the perforated board in the position shown in FIG. 4.

Figure 3:
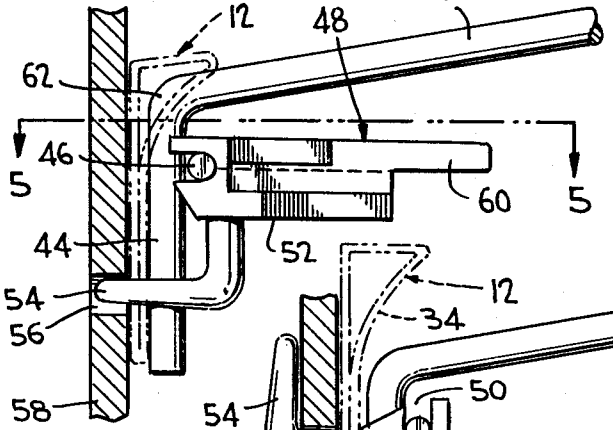
FIGS. 3 and 4 are respective side views of the proximal end portion of a product display hook showing the respective operations required for attaching the hook to a perforated board with the tag of FIGS. 1 and 2 being secured between the hook structure and the board.
Figure 4:
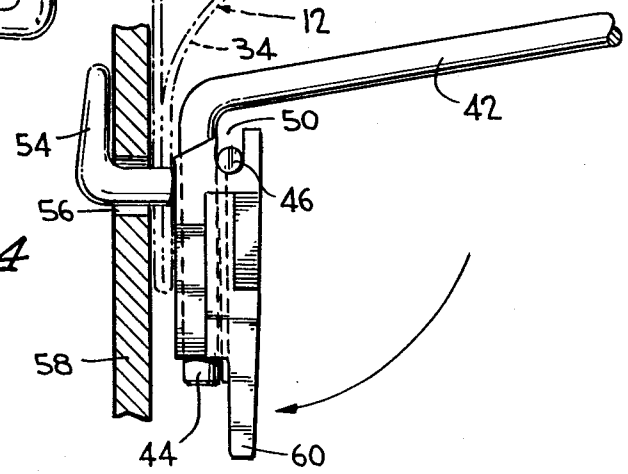
Figure 5:
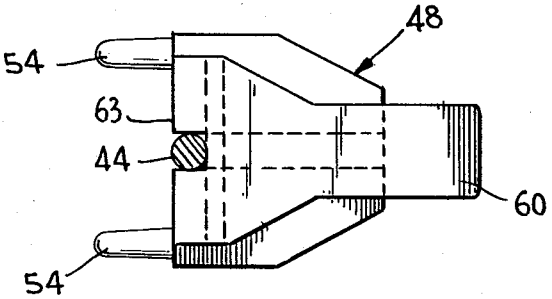
FIG. 5 is a view on line 5—5 of FIG. 3.

Normally, to secure the hook structure to a perforated board, first the bracket 48 is swung up to the position shown in FIG. 3 where tab 60 is adjacent the hook body 42 and the tips of prongs 54 are inserted in the apertures 56 and is depressed to flip the bracket 48 into the FIG. 4 position whereby the prongs 54 swing through the apertures 56 and grip against the back of the board 58 between the bracket and the board and securing the structure in place.

Figure 6:
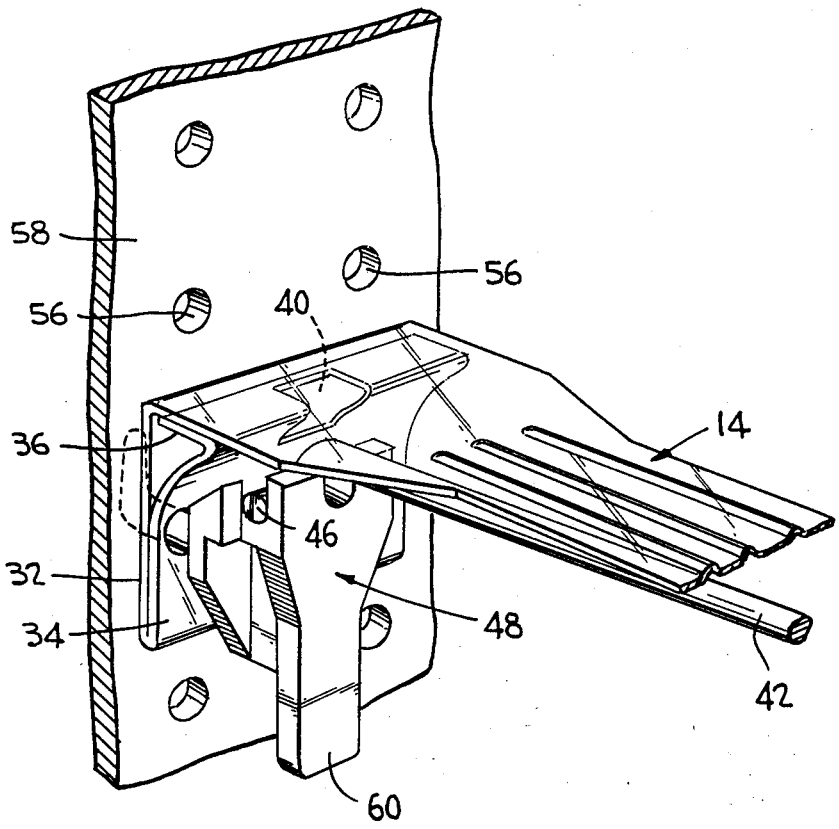
FIG. 6 is a perspective view of the combined hook and tag structure in the mounted position.

When the tag 10 is to be mounted on the hook structure, the mounting portion 12 is first folded into the wedge-like configuration shown in FIG. 2, and the hook prongs are inserted through the apertures 38 while the hook is in the configuration shown in FIG. 3. Then, the prongs 54 are inserted into the apertures 56, as previously described whereby the panels 32 and 34 of mounting portion 12 will be squeezed together between the board 58 and stem 44 of the hook as shown in FIG. 3. In this position of the assembly, a shoulder portion 62 of the hook forming the junction between hook body 42 and stem 44 is received in the cut-out 40 of the mounting portion, the cut-out being provided for this very purpose. When the bracket 48 is flipped or depressed downwardly into the FIG. 4 position to lock the structure in place, the shoulder portion 62 of the hook moves down out of the cut-out 40 and in the attached position of the hook, the top of the tag is elevated somewhat above the level of the hook itself as shown in FIGS. 4 and 6.

It is evident that when the tab 10 is mounted in the manner described, the wedge formation defined by the respective panels of the mounting portion is squeezed together and effectively trapped and held between the stem 44 of the hook and the perforated board 58. The tab may be readily released and detached by lifting the bracket 48 and releasing the prongs 54 from the board. The cut-out 40 provides clearance and accommodation for the shoulder portion 62 of the hook both when attaching and detaching the structure from the perforated board.

While only a preferred embodiment of the invention has been described herein in detail, the invention is not limited thereby and modifications can be made within the scope of the attached claims.

What is claimed is:

1. A product information and display tag comprising an elongate blank of sheet material having a proximal end mounting portion for attachment at a proximal end of an elongate product display hook, an elongate intermediate portion extending from the mounting portion for projecting over the hook, and a distal end display portion at a distal end of the intermediate portion for displaying product information at a distal end of the hook, wherein the mounting portion of the blank comprises a lengthwise succession of panels for folding into a wedge behind the intermediate portion with adjacent ones of said panels defining front and rear wedge surfaces converging downwardly to an apex, a pair of transversely spaced apertures in each of said panels adapted to align when the panels are folded as aforesaid for allowing suitably spaced hook prongs to be inserted through the wedge, and a central cut-out in one of said adjacent ones of said panels which defines the front wedge surface, said cut-out being located substantially at one end of said one panel which defines an upper end of the front wedge surface.

2. The invention as defined in claim 1 wherein the succession of panels includes a third panel extending from said one of said adjacent panels for defining a top portion of the wedge, the third panel being shorter lengthwise of the blank than each of said adjacent panels.

3. The invention of claim 2 wherein said cut-out extends into said third panel.

4. The invention of claim 3 wherein the panels are separated by respective fold lines extending across the blank.

5. The invention as defined in claim 1 wherein the intermediate portion of the blank is narrower than the mounting portion and the display portion, and is provided with lengthwise reinforcement ribbing.

6. The invention as defined in claim 1 wherein the display portion of the blank includes a fold-down display panel.

7. In combination with a product display hook structure comprising an elongate rod-like hook body having a proximal end formed with a depending stem and a shoulder forming a junction between the body and the stem, a pivotal bracket with rearwardly extending hook-like prongs attached to the stem for mounting the hook structure on a perforated board by insertion of the prong into adjacent apertures of the board and downward pivotal movement of the bracket, whereby the prongs are moved into gripping engagement behind the board and the stem is trapped between the bracket and a front surface of the board, a product information and display tag of sheet material comprising a proximal end mounting portion for trapping between said bracket and the front surface of the board, an elongate intermediate portion extending from the mounting portion for projecting over the length of the hook body, and a distal end display portion for displaying product information at a distal end of the hook body, wherein the mounting portion is formed as a wedge having front and rear panels converging downwardly from the intermediate portion to an apex, aligned apertures in the respective panels for receipt of the hook-like prongs, and central cut-out in an upper portion of the front panel for receiving said shoulder of the hook body prior to said downward pivotal movement of the bracket.

8. The invention as defined in claim 7 wherein the wedge has a top panel extending from the front panel and wherein said cut-out extends into the top panel.

* * * * *